US005940984A

United States Patent [19]

Morén

[11] Patent Number: 5,940,984

[45] Date of Patent: Aug. 24, 1999

[54] METHOD FOR DRYING WOOD

[75] Inventor: Tom Morén, Skellefteå, Sweden

[73] Assignee: Utec Sm Ab, Skelleftea, Sweden

[21] Appl. No.: 09/029,153

[22] PCT Filed: Jul. 5, 1996

[86] PCT No.: PCT/SE96/00919

§ 371 Date: May 21, 1998

§ 102(e) Date: May 21, 1998

[87] PCT Pub. No.: WO97/08504

PCT Pub. Date: Mar. 6, 1997

[30] Foreign Application Priority Data

Aug. 14, 1995 [SE] Sweden ..... 9502823

[51] Int. Cl.[6] ..... F26B 7/00

[52] U.S. Cl. ..... 34/396; 34/493; 34/497

[58] Field of Search ..... 34/396, 418, 443, 34/493, 497, 548; 110/190, 233, 244

[56] References Cited

U.S. PATENT DOCUMENTS

| | | | |
|---|---|---|---|
| 3,699,665 | 10/1972 | Shinskey | 34/549 |
| 4,620,373 | 11/1986 | Laskowski et al. | 34/406 |
| 4,777,604 | 10/1988 | Robinson | 364/477 |
| 4,953,298 | 9/1990 | Carter et al. | 34/526 |
| 5,050,313 | 9/1991 | Wakaeya et al. | 34/454 |
| 5,595,000 | 1/1997 | Goodwin, III | 34/471 |
| 5,687,490 | 11/1997 | Harrison | 34/92 |

*Primary Examiner*—Henry Bennett
*Assistant Examiner*—Steve Gravini
*Attorney, Agent, or Firm*—Pillsbury Madison & Sutro LLP

[57] ABSTRACT

The invention relates to a method of drying wood in a drying chamber (1), wherein a drying medium, for instance air, is circulated through a batch of wood (10) placed in the drying chamber (1) in a wood-drying process. The drop in temperature (ΔT) of the drying medium is measured in conjunction with passage of the drying medium through the wood batch (10), and the temperature drop therewith obtained is used to control or regulate the state of the circulating drying medium with regard to its moisture content and temperature, for instance. The dry temperature (T) and the wet temperature (TV) of the circulating dry medium are also measured in the proximity of the wood batch (10), and the temperature information therewith obtained is also used to control or regulate the state of the circulating drying medium with regard to its moisture content and temperature, for instance. According to the invention, the drying process takes place in a plurality of different phases (phases II–V) with varying control or regulating interaction between dry temperature drop (ΔT), dry temperature (T) and wet temperature (TV).

8 Claims, 2 Drawing Sheets

METHOD FOR DRYING WOOD

Figure 1:
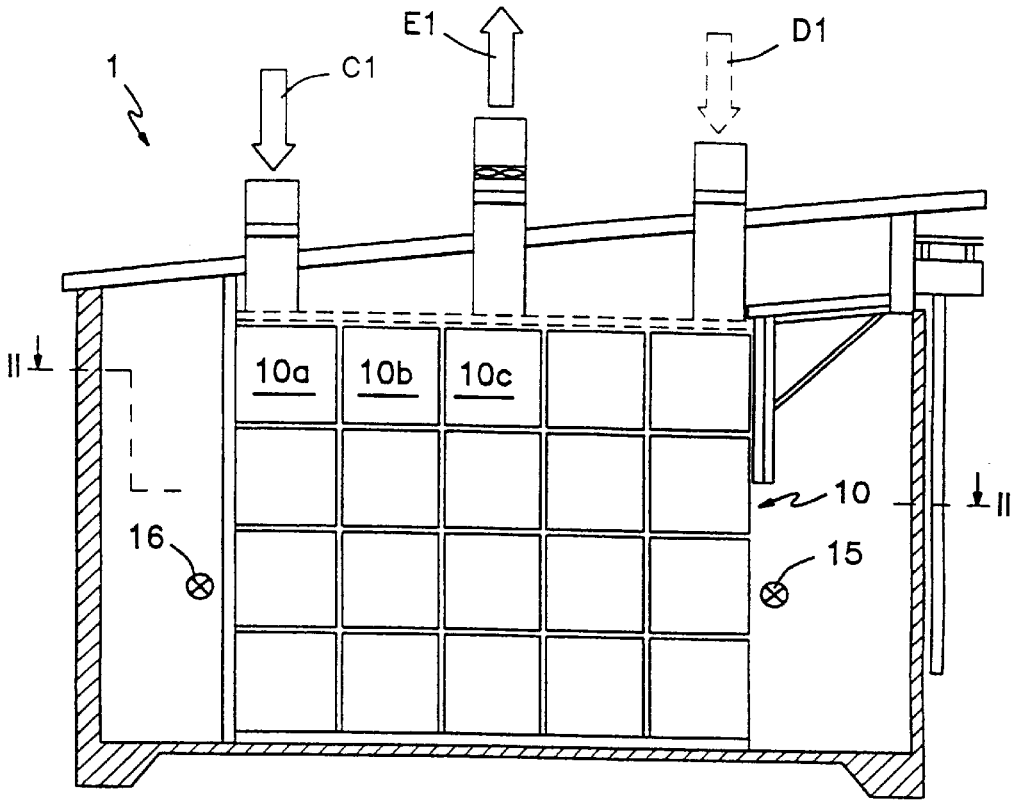

This application is the national phase of international application PCT/SE96/00919 filed Jul. 5, 1996 which designated the U.S.

The present invention relates to a method of drying wood in accordance with the preamble of claim 1.

Wood is dried industrially in so-called chamber dryers, by circulating air of given temperature and humidity around cross-laid layers of wood through openings defined between mutually superposed wood packs. The circulation air functions as a heat transferring and moisture transporting medium, wherein the heat required to dry the wood is supplied to the air through the medium of heating batteries, while the air is dehumidified by ventilation, for instance by diluting with cold, dry outdoor air.

Chamber-drying processes are at present controlled in many different ways. The principle on which drying climates are controlled is normally based on an established control schedule which allows air temperature and air humidity to vary in a predetermined manner throughout the whole of the drying process. It is known from experience, for instance, that the rate at which wood is dried must be constrained during the first stage of the drying process, otherwise the wood will split. Similarly, the chamber temperature is often increased during the latter part of the drying process, in order to maintain the slow migration of moisture in the wood when the water is in a bound state.

There are at present many different types of drying schedules, which are either proposed by the supplier of the wood dryer or which have been tested locally in individual sawmills and wood yards. However, controlling of the drying process has a serious principle deficiency, since the state of the circulation air is not controlled in a feedback manner, i.e. the process control does not take into account the prevailing moisture-emitting properties and the initial moisture quotient of the wood. This can result in serious errors of judgement on the part of the operator responsible for the drying operation with regard to choice of drying schedule, with subsequent damage to the wood or time losses as a direct result. Judgement errors will also result in energy losses, of course. Excessive drying of the wood will also result in splitting and excessive shrinkage of the wood.

The object of the present invention is to provide a highly attractive and advantageous method of drying wood. This object is achieved with a wood drying method that has the characteristic features set forth in the following claims.

The following advantages are among the many advantages that are afforded by the invention: Because the drying process is controlled as a feedback system, the drying process can be adapted very effectively to the true drying requirements of the batch of wood concerned, therewith resulting in optimal drying of the wood. The invention also enables the establishment of a reliable time-point at which a desired final moisture quotient (average moisture quotient) is achieved, therewith enabling the drying process to be automatically interrupted and switched to an optional conditioning phase. This will avoid, for instance, excessive drying of the wood with subsequent splitting and excessive shrinkage of the wood. The inventive drying method is also highly energy-saving. The invention thus affords both technical and economical advantages.

Figure 2:
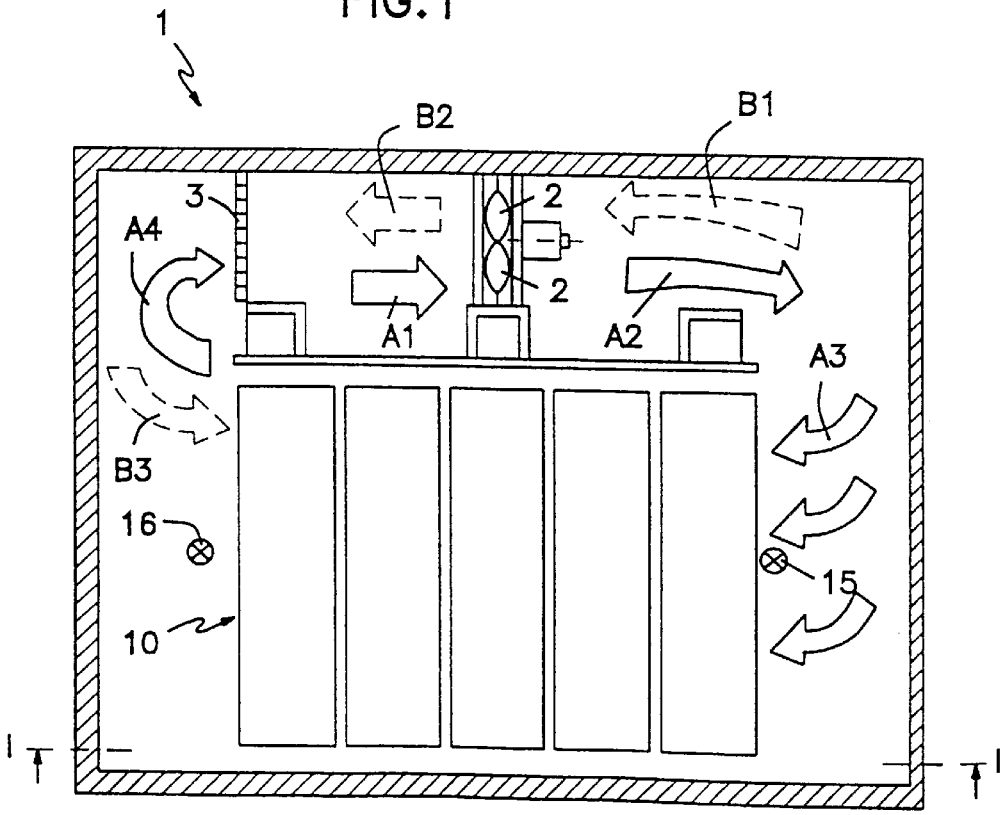

The invention will now be described in more detail with reference to exemplifying embodiments thereof and also with reference to the accompanying drawings, in which FIG. 1 is a vertical sectional view of a drying chamber; FIG. 2 is a horizontal sectional view of the drying chamber shown in FIG. 1; and FIG. 3 is a time-temperature diagram illustrating the inventive wood-drying method.

FIGS. 1 and 2 illustrate an example of a wood-dryer 1 with which the inventive method can be applied. The illustrated drying chamber 1 has a construction typical in the field and includes fans 2 and heating batteries 3. In addition, the chamber naturally also includes a floor, walls, ceiling and baffles for guiding circulating drying air through a batch of wood 10 to be dried in a desired manner. The batch of wood 10 will normally comprise a plurality of cross laid wood packs, designated 10*a,* 10*b,* 10*c,* and so on, in FIGS. 1 and 2. It will be understood, however, that the drying chamber 1 can be constructed differently to that illustrated in FIGS. 1 and 2. For instance, fans 2 and heating batteries 3 may be ceiling-mounted instead of being mounted on the sides of the chamber as in the illustrated case. It will also be understood that the inventive drying process is not restricted to a given type of drying chamber, and that the process can be applied to all conceivable types of drying chamber.

Figure 3:
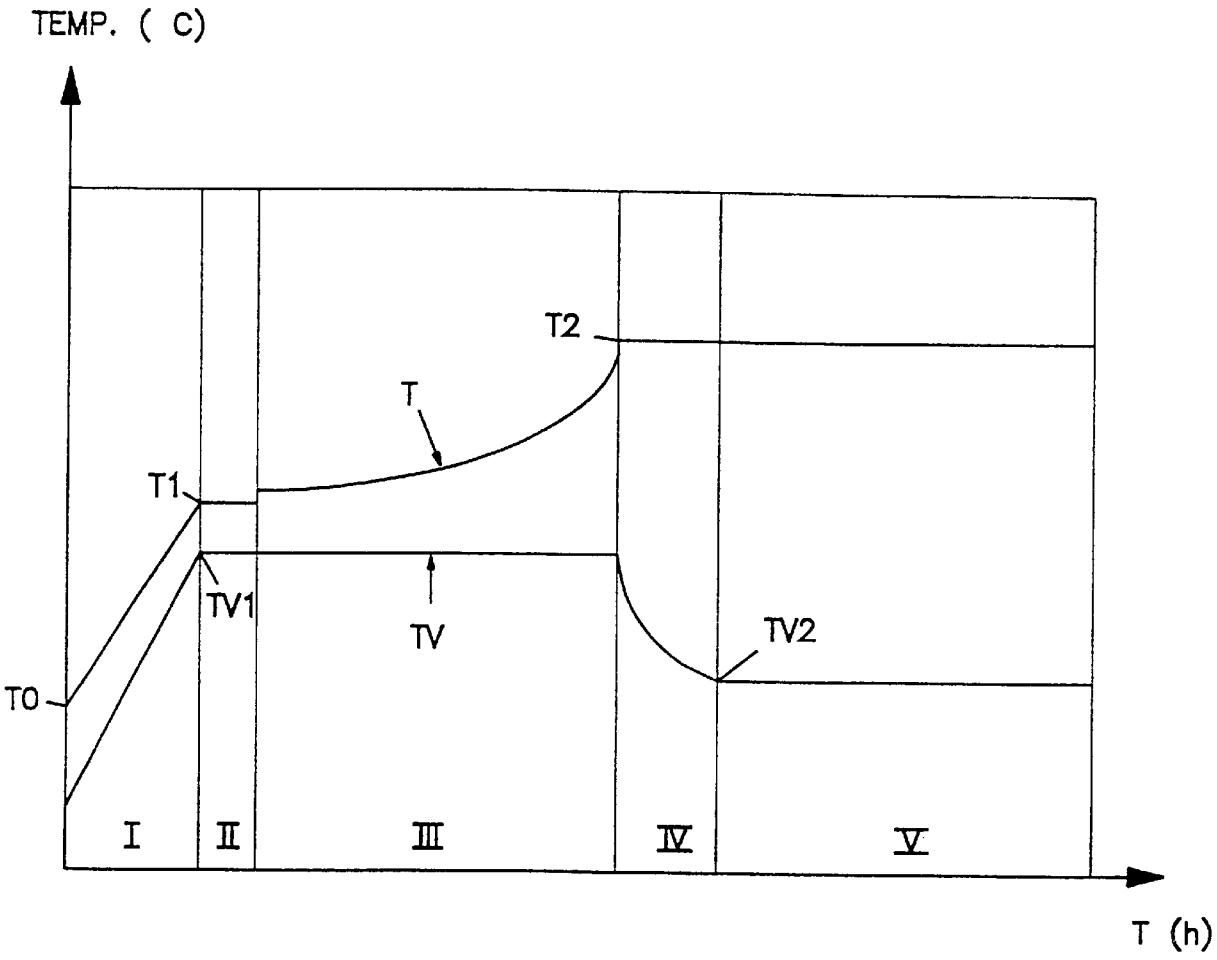

The drying chamber illustrated in FIGS. 1 and 3 enables the direction of air flow to be changed during the drying process, for instance by reversible operation of the fans 2. The direction of air flow is shown in FIG. 2 by full arrows A1–A4, while the opposite direction of air flow is indicated by broken-line arrows B1–B3. As indicated by the arrows C1 and D1, the ingress of outdoor air or ambient air is controlled by means of a throttle or valve, while exhaust air leaving the chamber is controlled by a throttle or valve as indicated by the arrow E1.

The inventive method is made possible by virtue of a sensor, for instance in the form of a psychrometer, mounted in the drying chamber. In this regard, a first psychrometer 15 is conveniently mounted adjacent the wood batch 10 on one side thereof, while a second psychrometer 16 is conveniently mounted on the opposite side of the wood batch 10, such that one psychrometer will be impinged upon by the circulation air as it enters a wood batch to be dried, and such that the other psychrometer will be impinged upon by the circulation air as it exits from said wood batch. Naturally, this applies irrespective of the prevailing direction of air circulation. In order to enable wood batches 10 to be placed in and removed from the drying chamber 1, it is necessary for the first psychrometer 15 to be mobile so that it can be moved to an inactive position in which wood packs can be moved into and out of the chamber, while enabling the psychrometer to be moved back to its active position prior to starting the drying process, as indicated in FIGS. 1 and 2. Both psychrometers 15 and 16 are able to measure both normal temperature (dry temperature) and wet temperature of the air circulating in the drying chamber. It will be understood that the psychrometers can be replaced with alternative measuring devices having the aforesaid temperature measuring qualifications. It is also possible to use only one single psychrometer or only one single measuring device when the direction of air circulation is reversed sufficiently often.

Naturally the drying chamber 1 will also be provided with the control apparatus and guide means necessary to carry out the inventive method.

The inventive wood-drying method will now be described in more detail.

This description if started from the stage in which the drying chamber 1 has been loaded with a wood batch 10 to be dried and in which the psychrometers 15 and 16 have been placed in suitable positions in the proximity of the inflow of circulation air to the wood batch and to the outflow of circulation air leaving said batch.

A first stage in the drying process involves a so-called heating phase (phase I). The purpose of this phase is to heat the wood without drying the same, wherein the wood will normally be sprayed with water and/or steam.

The duration of the heating phase will, of course, depend on the size of the wood batch 10 and its initial temperature TO, which often corresponds to the prevailing outdoor temperature, among other things.

The heating phase may be continued until the wood has been heated sufficiently to meet subsequent drying activities. The heating phase (phase I) is illustrated in FIG. 3, wherein the upper curve (line) exemplifies the increase in dry temperature and the lower curve exemplifies the increase in wet temperature during the heating phase.

When a desired preheating level has been reached, phase I is accordingly terminated and phase II is initiated, this phase being referred to as the initiating phase.

The initiating phase (phase II) is effected in accordance with dry temperature (T1) control values (e.g. 55° C.) and wet-temperature (TV1) control value (e.g. 50° C.) that have been preset by the dryer operator. The choice of said temperature values is based on experience and, for instance, on the wishes of the customer with regard to the appearance of the wood. The choice of temperature is not a completely free choice, and upper and lower temperature limits are included in order to prevent damage to the wood in this stage of the process. Phase II, the initiating phase, is normally continued for from 3–6 hours.

The wood batch 10 begins to dry in the initiation phase, i.e. water vapour is given off to the circulation air, which therewith loses thermal energy and exhibits a continuously measurable drop in dry temperature as the air is blown through the batch. This dry temperature drop, ΔT, constitutes the temperature difference between dry temperatures measured by respective measuring devices 15 and 16 and may be in the region of 3° C., for instance. By forming a mean time value, this temperature drop ΔT can be read-off upon termination of the initiation phase (phase II), and the following phases controlled so that the temperature drop ΔT will be essentially equal to the mean value of the temperature drop obtained in the initiation phase (phase II). This operational control will result in an essentially constant drying rate in practice.

The wet temperature TV1 is maintained at a desired level, by removing heat, humid air and, for instance, supplying cold, dry outdoor air, for instance, with the aid of control valves, and by supplying heat at the same time so as to keep the dry temperature T1 at a desired level. The purpose of phase II is to obtain a response from the wood batch 10 concerned with regard to its moisture status. A large dry temperature drop ΔT across the wood batch 10 indicates that the wood has a high moisture content. A small dry temperature drop ΔT indicates the opposite. The object is to glean knowledge which can be utilized in subsequent phases so as to maintain the dry temperature drop ΔT (e.g. 3° C.) essentially constant.

After continuing the initiation phase (phase II) for a chosen length of time (e.g. 3–6 hours), the process is switched to the next phase, which can be referred to as the temperature increasing phase (phase III).

The dry temperature T1 can be defined as the mean value of the dry temperatures recorded by the psychrometers 15 and 16, and similarly the wet temperature TV1 may be comprised of the mean value of the wet temperatures recorded by the psychrometers 15 and 16. It will be understood, however, that the process can be based solely on the dry-temperature and wet-temperature recording on one of said two psychrometers, without departing from the inventive concept.

This discussion regarding temperature definition also applied in the following to dry and wet temperature during remaining phases.

In the temperature increasing phase (phase III), the wood drying process is controlled in a manner to keep the wet temperature TV1 (e.g. 50° C.) constant, whereas the dry temperature T is increased immediately the dry-temperature drop ΔT e.g. 3° C. between the sensors 15 and 16 tends to fall. This results in faster migration of moisture in the wood and it is possible to hold up evaporation in the wood surfaces to the same level as was earlier the case. This is allowed to continue until a preset upper limit temperature T2 (e.g. 65° C.) is reached. This dry temperature limit T2 is set within reasonable limits by a process responsible operator. The maximum temperature T2 is determined partly by wood appearance aspects and also by the heat sensitivity of mechanical equipment and electrical installations.

It shall thus be ensured that phase III takes place with the wet temperature TV (e.g. 50° C.) held constant and with an essentially constant temperature drop ΔT (e.g. 3° C.), wherewith the dry temperature T is allowed to increase from its value according to phase II (e.g. 55° C.) to a maximum value T2 (e.g. 65° C.) so as to essentially maintain the dry temperature drop ΔT (e.g. 3° C.) between the sensors 15 and 16. Effective moisture migration from the wood batch 10 is maintained in this way during the whole of phase III, which may have a duration of two calendar days, for instance. Phase III has been completed when the limited T2-value (e.g. 65° C.) has been reached.

When the temperature increasing phase (phase III) is terminated phase IV is commenced, this phase being referred to as the wet-temperature lowering phase.

The wet-temperature lowering phase (phase IV) is continued in a manner such as to maintain the dry temperature T2 (e.g. 65° C.) reached in phase III constantly at its limited maximum level, while lowering the wet temperature TV at the same time such that the dry temperature drop ΔT will still be essentially constant (e.g. 3° C.). Thus, an essentially constant dry-temperature drop ΔT (e.g. 3° C.) is also strived for in this phase, and is enabled by controlling operation of the dry chamber in a manner to lower the wet temperature from TV1 (e.g. 50° C.) to a limited minimum value TV2 (e.g. 45° C.). TV2 is limited downwards to avoid excessively pronounced surface-drying of the wood.

Evaporation of moisture from the wood can be kept at a constant level in the wet-temperature lowering phase (phase IV), by circulating drier air, i.e. by allowing the wet temperature TV to fall at the rate necessary to maintain a constant dry temperature drop ΔT. This drying phase involves allowing the moisture quotient of the wood surfaces to fall to a level set by the dryer operator in the form of said bottom limit temperature TV2 for the wet temperature. The wet-temperature lowering phase (phase IV) is often of relatively short duration in relation to the temperature increasing phase (phase III) and phase IV is thus terminated when the wet temperature TV2 reaches the bottom limit temperature (e.g. 45° C.).

When the wet-temperature lowering phase (phase IV) is terminated, the process controller will leave the stage of the wood-drying process in which the process is controlled on the basis of the dry temperature drop ΔT, i.e. where a constant or essentially constant temperature drop ΔT constitutes a control value and control parameter. The process control now passes to a final phase, which can be referred to as a constant holding phase or a plateau phase (phase V).

The constant holding phase/plateau phase (phase V) can be said to constitute a final phase of the actual drying part of the process and in the present case is intended to dry the wood batch to a predetermined mean moisture quotient. This is achieved by controlling the process in a manner to maintain the dry upper limit temperature T2 and the wet lower limit temperature TV2 constantly at the preset control values. In this regard, the drying process can be described generally as a diffusion controlled process at given border conditions, meaning that the moisture flow decreases together with the dry temperature drop ΔT.

The dry temperature T2 (e.g. 65° C.) and the wet temperature TV2 (e.g. 45° C.) are thus both constant during this phase. The dry temperature drop ΔT (initially 3° C., for instance) decreases successively during this phase when, e.g., the flow of circulation air is kept constant in relation to earlier phases. The aforesaid reduction in dry temperature drop ΔT causes the departure of moisture from the wood batch 10 to decrease successively. The mean moisture quotient of the wood batch 10 can be calculated on the basis of the dry temperature drop ΔT that prevails at each point in time and on the basis of the wood dimensions concerned, wherein the constant holding phase (phase V) is interrupted when the desired mean moisture quotient (e.g. 15%) has been reached, said phase having a duration of one calendar day, for instance.

Calculation of the mean moisture quotient is based on the following facts. By assuming that the moisture flow is diffusion controlled in the wood during phase V and that the border conditions are given by virtue of knowing the state and flow of the circulation air, there can be formulated an arithmetical algorithm by means of which the mean moisture quotient of the wood can be calculated. This enables the dry temperature drop ΔT to be read-off continuously in the control process, and a calculation to be made which continuously discloses the expected mean moisture quotient in the wood batch. When the calculated mean moisture quotient coincides with the given final moisture quotient, the drying process is interrupted and a switch is made to an optional conditioning phase.

Thus, when the constant holding phase (phase V) is terminated, the wood batch 10 may be subsequently treated in a conventional manner, for instance by conditioning and cooling the wood prior to its removal from the drying chamber 1.

The aforedescribed process control principles form the basic framework of the inventive feedback process control. This also includes a method of controlling the flow of circulation air, for instance with the aid of a frequency converter connected to the drive motors of the circulation fans.

In order to save energy, the flow of circulation air can be reduced during phase V, for instance in accordance with the following principles.

It is known that the air-flows in the final phase of the drying process need not be equally as large as at the beginning of the process. This is because the departure of moisture from the wood is controlled by different mechanisms in the initial and final drying phases respectively. Thus, expensive electric energy can be saved by reducing the flow and the rate of flow of the circulation air with no negative affect on the drying quality. This can also be affected in a feedback mode in accordance with the following model.

When the wood enters the constant holding phase (phase V), drying of the wood is relatively independent of the air flow rate/air flow, and depends mainly on the temperature of the wood and the diffusion rate associated therewith. It is thus possible to reduce the flow of circulation air without retarding the drying process, by using one of the following three alternatives, for instance:

1. Reducing the air flow to a constant and lower level.
2. Reducing the air flow in accordance with a time-controlled ramp function.
3. Reducing the air flow towards a constant dry temperature drop ΔT.

This last possibility deserves an additional comment. Thus, the circulation air flow/flow rate can also be controlled in the constant holding phase (phase V) so as to obtain a constant dry temperature drop ΔT. In principle, this means that instead of the dry temperature drop ΔT decreasing at a constant rate of air flow the opposite takes place, namely the rate of air flow or the flow of circulation air decreases so as to maintain the temperature drop ΔT constant.

Thus, this principle provides a very simple feedback control with regard to only one process parameter, the dry temperature drop ΔT, which also remains constant throughout the entire process. Naturally, the magnitude of the circulation air flow must also be taken into account when calculating the mean moisture quotient of the wood batch.

The aforedescribed control principle can be supplemented with an interface against the dryer operator, i.e. a supportive sub-program for strategic selection of process parameters. The control principle also provides the operator with wide control facilities over the process, despite the process being feedback self-regulating, among other things by the choice of border temperature levels. This also affords a pedagogical advantage, because the basic control principles can be easily related to the behaviour of wood in a dryer environment with regard to splitting tendencies, colour changes, resin migration, etc.

Neither is there anything to prevent different heating or conditioning methods being chosen, irrespective of whether they are applied in water-based systems or steam-based systems or combinations thereof.

It will be understood that such parameters as drying chamber acclimatization, air flows, etc., are controlled in a manner which will enable the inventive drying method to be carried out in accordance with established principles. Reversal of the flow of circulation air will suitably take place at regular time intervals. A maximum flow of circulation air is normally used during phases I to IV, whereas the circulation air flow in phase V may be chosen in accordance with different principles as indicated above.

It should be noted that phase II must always be run, in order to obtain information necessary for the following phases. Either phase III or phase IV must also be run. It is necessary to run phase IV, so that the final moisture quotient can be calculated.

When necessary, the drying process can be carried out with the use of only one psychrometer, provided that the air flow in the drying chamber is reversed often enough. Naturally, measuring devices other than psychrometers may be used, providing that these devices will provide the necessary temperature information.

It will also be understood that other drying media than air can be used when such use is found appropriate.

It will also be understood that the aforesaid temperature examples are not limiting in any way, and that temperature control values and temperature limits can be chosen in accordance with prevailing conditions and circumstances. It will also be seen that a constant temperature implies in practice a substantially constant temperature, since control equipment and regulating equipment will naturally have limitations, among others.

Also worthy of mention is the possibility of controlling and regulating the dry temperature drop ΔT in a manner to follow a predetermined variation pattern, as an alternative to the earlier mentioned essentially constant dry temperature drop ΔT, wherein if desirable said variation pattern will deviate from the aforesaid constant maintained temperature drop during one or more of the relevant phases II–IV and possibly phase V.

In the feedback control system described above, the dry temperature change ΔT of the circulation air obtained when blowing air through the wood batch 10 is the central feedback parameter. The greater the temperature drop ΔT, the greater the departure of moisture from the wood. It is possible to calculate from the thermodynamics of the air the relationship between the dry temperature drop ΔT and the departure of moisture when certain base parameters are known, for instance the circulation air flow and the amount of wood involved. In other words, the requisite information can be readily obtained by placing, e.g., psychrometers on a respective side of the wood batch. In this regard, it is important that the dry thermometers are positioned so that a representative value of the temperature drop of the circulation air can be obtained without interference from leakage air and the like. Naturally, positioning of the measuring devices and the number of such devices, for instance psychrometers, may be varied in accordance with prevailing conditions, so as to enable sufficiently reliable measurement values to be obtained for controlling the wood-drying process.

The invention is thus not restricted to the illustrated and described embodiments thereof, since changes and modifications can be made within the scope of the following claims.

I claim:

1. A method of drying wood in a drying chamber wherein a drying medium, preferably air, is caused to circulate through a batch of wood (10) placed in the drying chamber (1) during a drying process, characterized in that with the intention of obtaining an essentially constant wood-drying rate, there is carried out after an initial wood heating phase (phase I) an initiation phase (phase II) in which the moisture status of the wood batch is established by measuring the dry temperature drop (ΔT) of the drying medium subsequent to its passage through said batch; and in that in subsequent drying phases the temperature drop (ΔT) of the drying medium is measured after its passage through said wood batch (10), wherein the temperature drop information thus obtained is compared with the temperature drop (ΔT) of the drying medium during the initiation phase (phase II) for controlling or regulating the state of the circulating drying medium such as to hold the temperature drop (ΔT) during subsequent drying phases essentially equal to the temperature drop in the initiation phase.

2. A method according to claim 1, characterized by establishing the moisture status of the wood batch while maintaining the dry temperature (T) and the wet temperature (TV) at an essentially constant level (T1, TV1).

3. A method according to claim 1, characterized by carrying out a dry temperature increasing phase (phase III) and a wet temperature lowering phase (phase IV) after said initiation phase (phase II), by controlling and regulating the state of the circulating medium.

4. A method according to claim 3, characterized in that the wet temperature lowering phase (phase IV) is preceded by the dry temperature increasing phase (phase III).

5. A method according to claim 1, characterized by forming a mean value from the temperature drop information (ΔT) obtained from the initiation phase (phase II).

6. A method according to claim 3, characterized in that subsequent to the temperature increasing phase (phase III) and the wet temperature lowering phase (phase IV), there is carried out a constant holding phase (phase V) in which both dry temperature (T) and wet temperature (TV) are held essentially constant during continued drying of the wood so as to enable the mean moisture quotient of the wood batch (10) concerned to be calculated and so as to enable the drying process to be interrupted at a point in time when the desired final moisture quotient (mean moisture quotient) has been obtained in respect of the wood batch, whereafter conditioning and cooling may optionally be commenced.

7. A method according to claim 1, characterized by maintaining a substantially constant flow of circulation medium in the drying chamber (1) during the initiation phase (phase II), the dry temperature increasing phase (phase III) and the wet temperature lowering phase (phase IV).

8. A method according to claim 6, characterized by reducing the flow of circulation medium in the drying chamber (1) during the constant holding phase (phase IV) to a level lower than the levels in earlier phases.

* * * * *